US006683821B1

(12) United States Patent
Emtyazi

(10) Patent No.: US 6,683,821 B1
(45) Date of Patent: Jan. 27, 2004

(54) DAY AND NIGHT DEPICTING CLOCK DEVICE

(76) Inventor: Hassan Emtyazi, 3704 West 12th Avenue, Vancouver, B.C. (CA), V6R 2N6

( * ) Notice: Subject to any disclaimer, the term of this patent is extended or adjusted under 35 U.S.C. 154(b) by 308 days.

(21) Appl. No.: 09/826,648

(22) Filed: Apr. 5, 2001

Related U.S. Application Data

(63) Continuation-in-part of application No. 09/466,085, filed on Dec. 17, 1999, now abandoned.

(51) Int. Cl.[7] ..... G04B 19/06
(52) U.S. Cl. ..... 368/77; 368/233
(58) Field of Search ..... 368/77, 233, 234; 434/304

(56) References Cited

U.S. PATENT DOCUMENTS

| | | | | |
|---|---|---|---|---|
| 2,011,517 A | * | 8/1935 | Geoffrion | 368/233 |
| 2,785,530 A | * | 3/1957 | Mayer | 368/233 |
| 3,595,009 A | | 7/1971 | Pakter | |
| 3,777,475 A | | 12/1973 | Grossan | |
| 4,849,949 A | | 7/1989 | Voth | |
| 4,939,708 A | * | 7/1990 | Pincemy | 368/233 |
| 5,088,440 A | * | 2/1992 | Keaney | 368/233 |
| 5,349,572 A | | 9/1994 | Belik | |
| 5,586,089 A | | 12/1996 | McGarvey | |
| 5,662,479 A | * | 9/1997 | Rogers | 434/304 |

* cited by examiner

*Primary Examiner*—David Martin
*Assistant Examiner*—Jeanne-Marguerite Goodwin

(57) ABSTRACT

A day and night depicting clock device for demonstrating daytime and nighttime on a clock. The device includes a clock having a clock face wall and an hour drive shaft rotating once every twelve hours. A first disk is mounted on the hour drive shaft for rotation with the hour drive shaft, has a radially extending first slot, is formed of a resiliently flexible material to permit flexing of a portion of the first disk, and has a relatively light color to identify a daytime period. A second disk is positioned behind the first disk, is fixed against rotation with respect to the clock face wall, has a radially-extending second slot, is formed from a resiliently flexible material to permit flexing of a portion of the second disk, and has a relatively dark color to identify a night-time period. The first disk is movable through the second slot of the second disk. A shifting assembly shifts a portion of one of the disks with respect to another of the disks to cause the first disk to move through the second slot of the second disk to shift the first disk either from a position behind the second disk to a position in front of the second disk or from a position in front of the second disk to a position in behind the second disk. An actuating assembly periodically actuates the shifting assembly.

20 Claims, 4 Drawing Sheets

DAY AND NIGHT DEPICTING CLOCK DEVICE

REFERENCE TO RELATED APPLICATION

This application is a continuation-in-part of Application No. 09/466,085, filed Dec. 17, 1999, now abandoned.

BACKGROUND OF THE INVENTION

1. Field of the Invention

The present invention relates to a clock or watch which has a face that changes color due to the time of day and more particularly pertains to a new day and night depicting clock device for demonstrating daytime and nighttime on a clock.

2. Description of the Prior Art

The use of a clock or watch that has a face that changes color due to the time of day is known in the prior art. More specifically, clocks or watches which has a face that changes color due to the time of day are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,777,475; U.S., Pat. No. 3,595,009; U.S. Pat. No. 5,349,572; U.S. Pat. No. 5,586,089; U.S. Pat. No. Des. 251,362; and U.S. Pat. No. Des. 286,755.

While these devices fulfill their respective, particular objectives and requirements, the aforementioned patents do not disclose a new day and night depicting clock device. The inventive device includes a clock having a clock face wall and an hour drive shaft rotating once every twelve hours. A first disk is mounted on the hour drive shaft for rotation with the hour drive shaft, has a radially extending first slot, is formed of a resiliently flexible material to permit flexing of a portion of the first disk, and has a relatively light color to identify a daytime period. A second disk is positioned behind the first disk, is fixed against rotation with respect to the clock face wall, has a radially-extending second slot, is formed from a resiliently flexible material to permit flexing of a portion of the second disk, and has a relatively dark color to identify a night-time period. The first disk is movable through the second slot of the second disk. A shifting assembly shifts a portion of one of the disks with respect to another of the disks to cause the first disk to move through the second slot of the second disk to shift the first disk either from a position behind the second disk to a position in front of the second disk or from a position in front of the second disk to a position behind the second disk. An actuating assembly periodically actuates the shifting assembly.

In these respects, the day and night depicting clock device according to the present invention substantially departs from the conventional concepts and designs of the prior art, and in so doing provides an apparatus primarily developed for the purpose of demonstrating daytime and nighttime on a clock.

SUMMARY OF THE INVENTION

In view of the foregoing disadvantages inherent in the known types of a clock or watch which has a face that changes color due to the time of day now present in the prior art, the present invention provides a new day and night depicting clock device construction wherein the same can be utilized for demonstrating daytime and night-time on a clock.

The general purpose of the present invention, which will be described subsequently in greater detail, is to provide a new day and night depicting clock device which has many of the advantages of the clock or watch which has a face that changes color due to the time of day mentioned heretofore and many novel features that result in a new day and night depicting clock device which is not anticipated, rendered obvious, suggested, or even implied by any of the prior art a clock or watch which has a face that changes color due to the time of day, either alone or in any combination thereof.

To attain this, the present invention generally comprises a clock having a clock face wall and an hour drive shaft rotating once every twelve hours. A first disk is mounted on the hour drive shaft for rotation with the hour drive shaft, has a radially extending first slot, is formed of a resiliently flexible material to permit flexing of a portion of the first disk, and has a relatively light color to identify a daytime period. A second disk is positioned behind the first disk, is fixed against rotation with respect to the clock face wall, has a radially-extending second slot, is formed from a resiliently flexible material to permit flexing of a portion of the second disk, and has a relatively dark color to identify a night-time period. The first disk is movable through the second slot of the second disk. A shifting assembly shifts a portion of one of the disks with respect to another of the disks to cause the first disk to move through the second slot of the second disk to shift the first disk either from a position behind the second disk to a position in front of the second disk or from a position in front of the second disk to a position behind the second disk. An actuating assembly periodically actuates the shifting assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new day and night depicting clock device which has many of the advantages of the clock or watch which has a face that changes color due to the time of day mentioned heretofore and many novel features that result in a new day and night depicting clock device which is not anticipated, rendered obvious, suggested, or even implied by any of the prior art, either alone or in any combination thereof.

It is another object of the present invention to provide a new day and night depicting clock device that may be easily and efficiently manufactured and marketed.

It is a further object of the present invention to provide a new day and night depicting clock device that is of a durable and reliable construction.

An even further object of the present invention is to provide a new day and night depicting clock device which is susceptible of a low cost of manufacture with regard to both materials and labor, and which accordingly is then susceptible of low prices of sale to the consuming public, thereby making such day and night depicting clock device economically available to the buying public.

Still yet another object of the present invention is to provide a new day and night depicting clock device which provides in the apparatuses and methods of the prior art some of the advantages thereof, while simultaneously overcoming some of the disadvantages normally associated therewith.

Still another object of the present invention is to provide a new day and night depicting clock device for demonstrating daytime and nighttime on a clock.

Yet another object of the present invention is to provide a new day and night depicting clock device that includes a clock having a clock face wall and an hour drive shaft rotating once every twelve hours. A first disk is mounted on the hour drive shaft for rotation with the hour drive shaft, has a radially extending first slot, is formed of a resiliently flexible material to permit flexing of a portion of the first disk, and has a relatively light color to identify a daytime period. A second disk is positioned behind the first disk, is fixed against rotation with respect to the clock face wall, has a radially-extending second slot, is formed from a resiliently flexible material to permit flexing of a portion of the second disk, and has a relatively dark color to identify a night-time period. The first disk is movable through the second slot of the second disk. A shifting assembly shifts a portion of one of the disks with respect to another of the disks to cause the first disk to move through the second slot of the second disk to shift the first disk either from a position behind the second disk to a position in front of the second disk or from a position in front of the second disk to a position behind the second disk. An actuating assembly periodically actuates the shifting assembly.

Still yet another object of the present invention is to provide a new day and night depicting clock device that is an eye-catching way of illustrating the hours of day and night.

Even still another object of the present invention is to provide a new day and night depicting clock device that is a decorative alternative to standard clocks.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
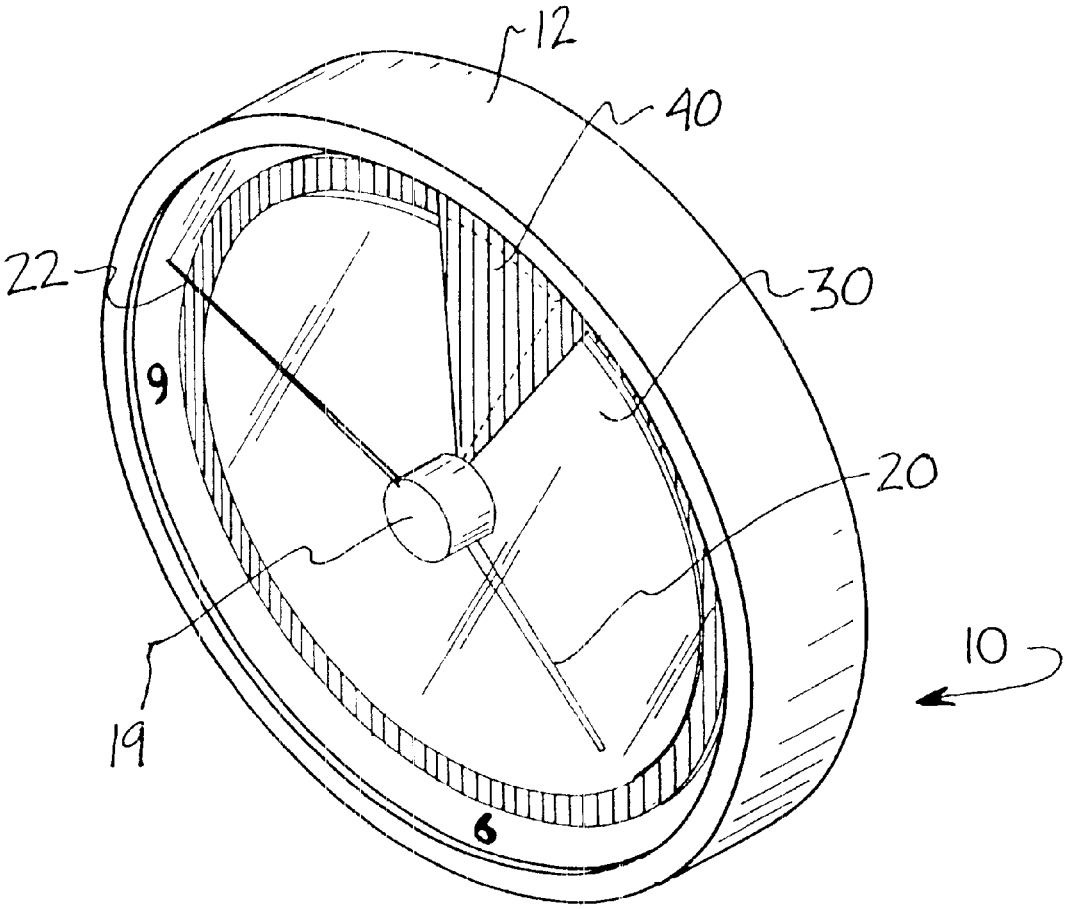
FIG. 1 is a perspective view of a new day and night depicting clock device according to the present invention.
Figure 2:
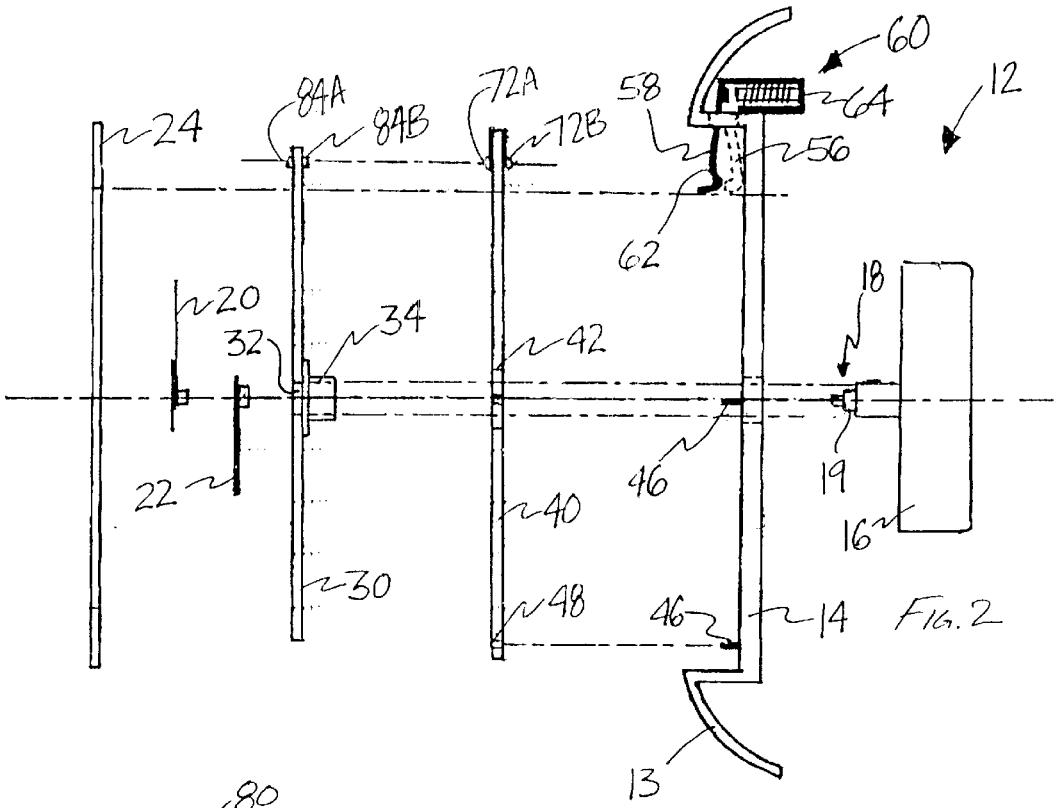
FIG. 2 is a side exploded view of the clock device of the present invention.
Figure 3:
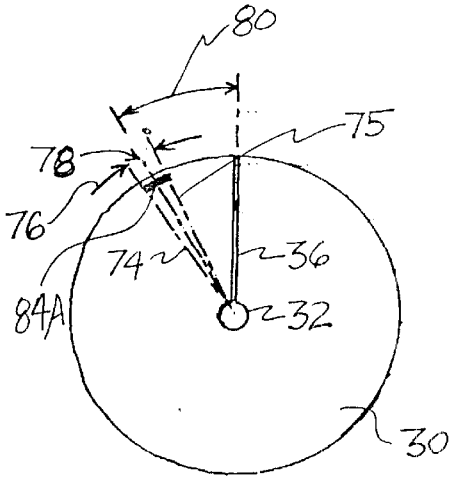
FIG. 3 is a front view of the first disk of the present invention particularly illustrating the first slot and the connector strip.
Figure 4:
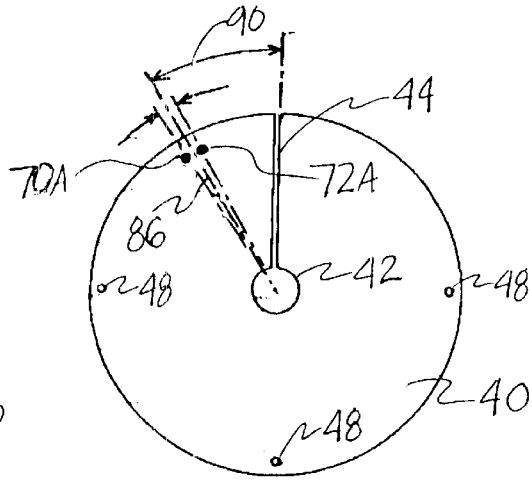
FIG. 4 is a front view of the second disk of the present invention particularly illustrating the second slot and the pair of contacts.
Figure 5:
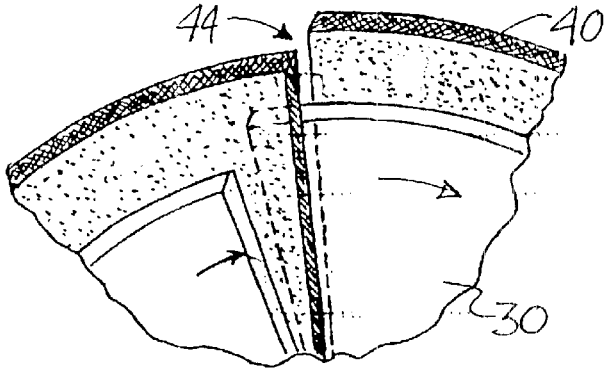
FIG. 5 is a front perspective view of a broken away portion of the first and second disks showing the interleaving of the disks relative to each other just before noon is indicated by the device of the present invention.
Figure 6:
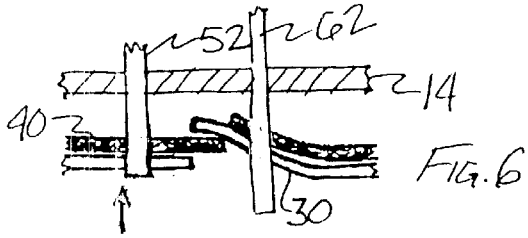
FIG. 6 is an edge view looking down on the first and second disks from the perspective of the twelve o'clock position just before noon is indicated and corresponding to the positioning of the disks shown in FIG. 5, and showing the shifting of the disks toward the clock face wall by the left shifting arm.
Figure 7:
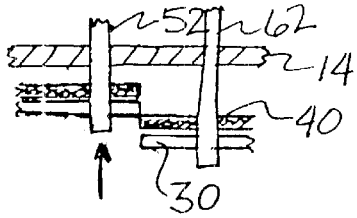
FIG. 7 is an edge view looking down on the first and second disks from the perspective of the twelve o'clock position just as noon is being indicated on the present invention, and showing the shifting of the disks toward the clock face wall by the left shifting arm.
Figure 8:
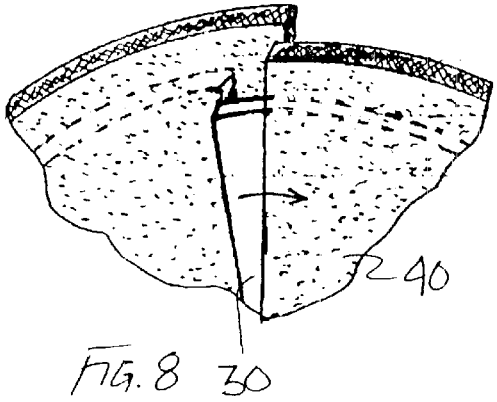
FIG. 8 is a front perspective view of a broken away portion of the first and second disks showing the interleaving of the disks relative to each other just before midnight is indicated by the device of the present invention.
Figure 9:
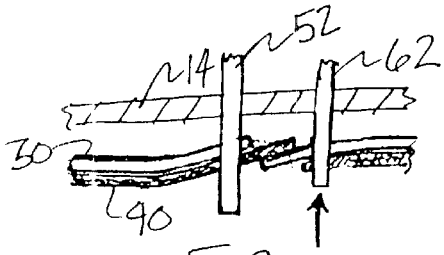
FIG. 9 is an edge view looking down on the first and second disks from the perspective of the twelve o'clock position just before midnight is indicated and corresponding to the positioning of the disks shown in FIG. 8, and showing the shifting of the disks toward the clock face wall by the right shifting arm
Figure 10:
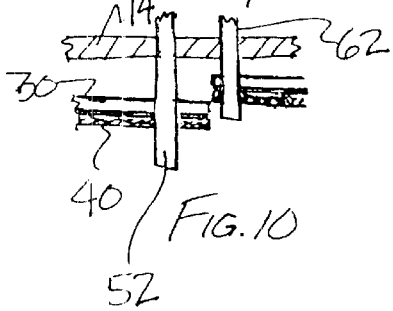
FIG. 10 is an edge view looking down on the first and second disks from the perspective of the twelve o'clock position just as midnight is being indicated on the present invention, and showing the shifting of the disks toward the clock face wall by the right shifting arm.
Figure 11:
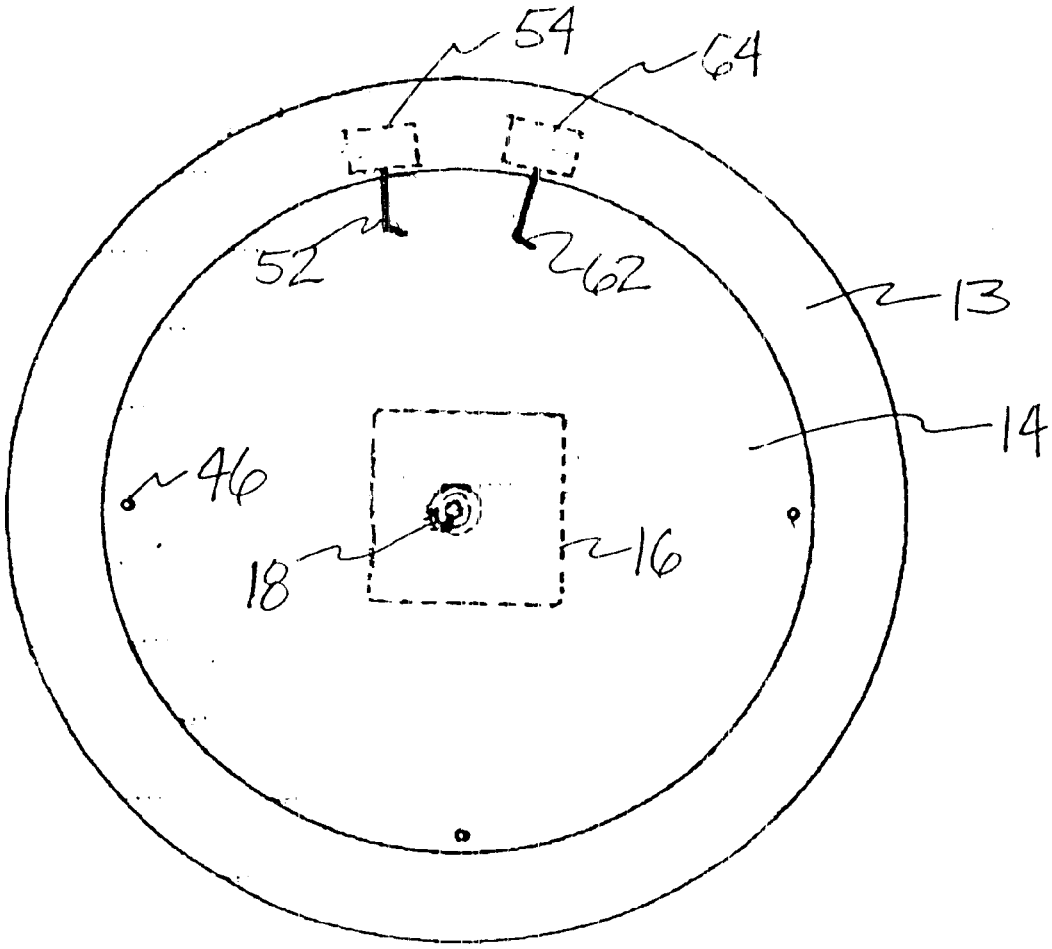
FIG. 11 is a front view of the clock body showing the positioning of the shifting assemblies.

With reference now to the drawings, and in particular to FIGS. 1 through 11 thereof, a new day and night depicting clock device embodying the principles and concepts of the present invention and generally designated by the reference numeral 10 will be described.

A day and night depicting clock device of the present invention includes a clock 12 having a clock body 13, and the clock body has a clock face wall 14. The clock may have a clock movement 16 mounted on the clock body with a plurality of concentric drive shafts 18 extending through the clock face wall and including an hour drive shaft 19 rotating once every twelve hours. A pair of time-displaying hands 20, 22 are mounted on the drive shafts, and an annular bezel 24 may be mounted on the clock body in front of the clock face wall.

A first disk 30 is positioned in front of the clock face wall and mounted on the hour drive shaft 19 for rotation with the hour drive shaft. The first disk includes a first central hole 32 extending through a center of the first disk. A collar 34 may be mounted on the first disk adjacent to the first central hole and may also be mounted on the hour drive shaft. A first slot 36 extends radially in the first disk from the first central hole to an outer edge of the first disk. The first disk is preferably formed out of a resiliently flexible material to permit flexing of a portion of the first disk out of a plane of a remainder portion of the first disk. The first disk also preferably has a relatively light color to identify a daytime (for example, A.M.) period.

A second disk 40 is positioned in front of the clock face wall and behind the first disk 30. The second disk is fixed against rotation with respect to the clock face wall. This may be accomplished by one or more pins 46 protruding from the clock face wall 14, and one or more corresponding holes 48 in the second disk receiving the pins. The second disk 40 includes a second central hole 42 extending through a center of the second disk. A second slot 44 extends radially from the second central hole to an outer edge of the second disk. The second disk is preferably formed from a resiliently flexible material to permit flexing of a portion of the second disk out of a plane of a remainder portion of the second disk. The second disk also preferably has a relatively dark color to identify a nighttime (for example, P.M.) period. The second disk may have a diameter greater than a diameter of a first disk for permitting the shifting means to contact the second disk without contacting (and possibly impeding rotation of) the first disk. Also, the smaller diameter of the first disk allows the first disk to rotate without contacting the pins 46 supporting the second disk. The first disk is movable through the second slot of the second disk as the first disk rotates on the hour drive shaft.

Shifting means is provided for shifting a portion of one of the disks with respect to an other of the disks. The shifting means may selectively move a portion of the disks toward the clock face wall to cause the first disk to move through the second slot of the second disk to shift the first disk either from a position behind the second disk to a position in front of the second disk or from a position in front of the second disk to a position behind the second disk.

In one embodiment of the invention, the shifting means comprises a pair of shifting assemblies 50, 60. Each of the shifting assemblies is positioned laterally to a twelve o'clock position on the clock face wall so that the shifting assemblies are laterally spaced from each other. A left one 50 of the shifting assemblies is positioned laterally left of the twelve o'clock position and a right one 60 of the shifting assemblies is positioned laterally right of the twelve o'clock position.

Each of the shifting assemblies may comprise a shifting arm 52, 62 and a shifting solenoid 54, 64. The shifting arm is provided for selectively contacting a location on the second disk for shifting the disks toward the clock face wall. The shifting arm may extend over the clock face wall from a position radially outward from the clock face wall, and press against the disks toward the wall 14. The shifting arm may also be pivotally mounted on the clock body for moving between an active position 56 and a passive position 58. The active position 56 is relatively closer to the clock face wall 14 than the passive position 58. The shifting arm may be biased toward the passive position when the shifting solenoid is not energized.

The shifting solenoid 54, 64 is provided for moving the shifting arm toward the clock face wall, and from the passive position to the active position. The shifting solenoid may be mounted on the clock body adjacent to the clock face wall.

Actuating means may be provided for periodically actuating the shifting means. The actuating means may comprise an electrical actuating circuit for selectively energizing (or providing power to) the shifting solenoid of one of the shifting assemblies to move the respective shifting arm from the passive position to the active position. Which shifting assembly is activated depends upon whether the first disk is positioned substantially in front of or substantially behind the second disk.

The actuating circuit may comprise a pair of electrical contacts 72A mounted on one side of the second disk and another pair of electrical contacts 72B mounted on the opposite side of the second disk. One pair 70A, 72A of contacts are electrically connected to one of the shifting assemblies, and the other pair 70B, 72B of contacts are electrically connected to the other of the shifting assemblies. The contacts are operatively connected to the respective shifting assemblies and a power source such that electrically connecting one of the pairs of contacts completes or closes the electrical circuit of the respective shifting assembly, and causes the shifting solenoid to be energized and the shifting arm to be moved by the solenoid from the passive position to the active position for as long as the circuit is closed. The pair of electrical contacts may be circumferentially spaced from each other on each side of the second disk. Illustratively, radial axes 74, 75 pass through the electrical contacts define a contact separation angle 76. The contact separation angle in one illustrative embodiment of the invention measures approximately 5 degrees. Also, a contact bisecting axis 78 bisects the contact separation angle 76 and defines an offset angle 80 with respect to the second slot 44 of the second disk.

The actuating circuit may also include an electrical connector strip 84A, 84B mounted on both faces of the first disk for periodically completing or closing one of the actuating circuits of the shifting assemblies. The connector strip 84A, 84B is mounted on a face of the first disk at a location that permit the rotating first disk to periodically electrically connect one of the pairs of electrical contacts during rotation of the first disk with respect to the second disk, with the particular circuit being closed depending upon the position of the first disk with respect to the second disk (e.g., in front of or in back of). The connector strip 84A, 84B extends along an arc, and illustratively the arc measures approximately 10 degrees. The arc is bisected by a connector bisecting axis 86, and the connector bisecting axis is offset from the first slot 36 by an angle 90 that is approximately equal to the offset angle 80 of the pair of electrical contacts.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A day and night depicting clock device comprising:

a clock having a clock body, the clock body having a clock face wall, a clock movement mounted on the clock body and having a plurality of concentric drive shafts extending through the clock face wall including an hour drive shaft rotating once every twelve hours, a pair of time-displaying hands mounted on the drive shafts;

a first disk positioned in front of the clock face wall and mounted on the hour drive shaft for rotation with the hour drive shaft, the first disk including a first central hole through a center of the first disk, a first slot extending radially in the first disk from the first central hole to an outer edge of the first disk, the first disk being formed out of a resiliently flexible material to permit flexing of a portion of the first disk out of a plane of a remainder portion of the first disk, the first disk being a relatively light color to identify daytime;

a second disk positioned in front of the clock face wall and behind the first disk, the second disk being fixed against rotation with respect to the clock face wall, the second disk including a second central hole through a center of the second disk, a second slot extending radially from the second central hole to an outer edge of the second disk, the second disk being formed from a resiliently flexible material to permit flexing of a portion of the second disk out of a plane of a remainder portion of the second disk, the second disk being a relatively dark color to identify night-time, the first disk being movable through the second slot of the second disk;

shifting means for shifting a portion of one said disk with respect to another said disk, the shifting means selectively moving a portion of the disks toward the clock face wall to cause the first disk to move through the second slot of the second disk to shift the first disk either from a position behind the second disk to a position in front of the second disk or from a position in front of the second disk to a position behind the second disk; and actuating means for periodically actuating the shifting means;

wherein the shifting means comprises a pair of shifting assemblies, each of the shifting assemblies being positioned lateral to a twelve o'clock position on the clock face wall, a left one of the shifting assemblies being positioned laterally left of the twelve o'clock position and a right one of the shifting assemblies being positioned laterally right of the twelve o'clock position.

2. The clock device of claim 1 wherein each of the shifting assemblies comprises:

a shifting arm for selectively contacting a location on the second disk for shifting the disks toward the clock face wall; and a shifting solenoid for moving the shifting arm toward the clock face wall and from a passive position to an active position, the active position being relatively closer to the clock face wall than the passive position.

3. The clock device of claim 2 wherein the shifting arm extends over the clock face wall, the shifting arm being pivotally mounted on the clock body for moving between the active position and the passive position.

4. The clock device of claim 2 wherein the actuating means comprising an actuating circuit for selectively energizing the shifting solenoid to move the shifting arm from the passive position to the active position.

5. The clock device of claim 4 wherein the actuating circuit comprises:

a pair of electrical contacts mounted on the second disk; and an electrical connector strip mounted on the first disk in a location for periodically electrically connecting the pair of electrical contacts during rotation of the first disk with respect to the second disk.

6. The clock device of claim 5 wherein the pair of electrical contacts are circumferentially spaced from each other, and the connector strip extending along an arc.

7. The clock device of claim 6 wherein radial axes pass through the electrical contacts define a contact separation angle, a contact bisecting axis bisecting the contact separation angle, the contact bisecting axis defining an offset angle with respect to the second slot of the second disk, the arc of the connector strip being bisected by a connector bisecting axis, the connector bisecting axis being offset from the first slot by an angle approximately equal to the offset angle of the pair of electrical contacts.

8. The clock device of claim 7 wherein the contact separation angle measures approximately 5 degrees, the arc measuring approximately 10 degrees, the offset angle being approximately 30 degrees.

9. The clock device of claim 1 wherein each of the shifting assemblies comprises:

a shifting arm for selectively contacting a location on the second disk for shifting the disks toward the clock face wall; and a shifting solenoid for moving the shifting arm toward the clock face wall and from a passive position to an active position, the active position being relatively closer to the clock face wall than the passive position;

wherein the shifting arm extends over the clock face wall, the shifting arm being pivotally mounted on the clock body for moving between the active position and the passive position;

wherein the actuating means comprising an actuating circuit for selectively energizing the shifting solenoid to move the shifting arm from the passive position to the active position;

wherein the actuating circuit comprises:

a pair of electrical contacts mounted on the second disk; and an electrical connector strip mounted on the first disk in a location for periodically electrically connecting the pair of electrical contacts during rotation of the first disk with respect to the second disk;

wherein the pair of electrical contacts are circumferentially spaced from each other, and the connector strip extending along an arc;

wherein radial axes pass through the electrical contacts define a contact separation angle, a contact bisecting axis bisecting the contact separation angle, the contact bisecting axis defining an offset angle with respect to the second slot of the second disk, the arc of the connector strip being bisected by a connector bisecting axis, the connector bisecting axis being offset from the first slot by an angle approximately equal to the offset angle of the pair of electrical contacts;

wherein the contact separation angle measures approximately 5 degrees, the arc measuring approximately 10 degrees, the offset angle being approximately 30 degrees;

wherein the clock includes an annular bezel mounted on the clock body in front of the clock face wall; and wherein the second disk has a diameter greater than a diameter of a second disk.

10. A day and night depicting clock device comprising:

a clock having a clock body, the clock body having a clock face wall, a clock movement mounted on the clock body and having a plurality of concentric drive shafts extending through the clock face wall including an hour drive shaft rotating once every twelve hours, a pair of time-displaying hands mounted on the drive shafts;

a first disk positioned in front of the clock face wall and mounted on the hour drive shaft for rotation with the hour drive shaft, the first disk including a first central hole through a center of the first disk, a first slot extending radially in the first disk from the first central hole to an outer edge of the first disk, the first disk being formed out of a resiliently flexible material to permit flexing of a portion of the first disk out of a plane of a remainder portion of the first disk, the first disk being a relatively light color to identify daytime;

a second disk positioned in front of the clock face wall and behind the first disk, the second disk being fixed against rotation with respect to the clock face wall, the second disk including a second central hole through a center of the second disk, a second slot extending radially from the second central hole to an outer edge of the second disk, the second disk being formed from a resiliently flexible material to permit flexing of a portion of the second disk out of a plane of a remainder portion of the second disk, the second disk being a relatively dark color to identify night-time, the first disk being movable through the second slot of the second disk;

shifting means for shifting a portion of one said disk with respect to another said disk, the shifting means selectively moving a portion of the disks toward the clock face wall to cause the first disk to move through the second slot of the second disk to shift the first disk either from a position behind the second disk to a position in front of the second disk or from a position in front of the second disk to a position in behind the second disk; and actuating means for periodically actuating the shifting means;

wherein the clock includes an annular bezel mounted on the clock body in front of the clock face wall.

11. The clock device of claim 10 wherein the shifting means comprises a pair of shifting assemblies, each of the shifting assemblies being positioned lateral to a twelve o'clock position on the clock face wall, a left one of the shifting assemblies being positioned laterally left of the twelve o'clock position and a right one of the shifting assemblies being positioned laterally right of the twelve o'clock position.

12. The clock device of claim 11 wherein each of the shifting assemblies comprises:

a shifting arm for selectively contacting a location on the second disk for shifting the disks toward the clock face wall; and a shifting solenoid for moving the shifting arm toward the clock face wall and from a passive position to an active position, the active position being relatively closer to the clock face wall than the passive position.

13. The clock device of claim 12 wherein the shifting arm extends over the clock face wall, the shifting arm being pivotally mounted on the clock body for moving between the active position and the passive position.

14. The clock device of claim 12 wherein the actuating means comprising an actuating circuit for selectively energizing the shifting solenoid to move the shifting arm from the passive position to the active position.

15. The clock device of claim 14 wherein the actuating circuit comprises:

a pair of electrical contacts mounted on the second disk; and an electrical connector strip mounted on the first disk in a location for periodically electrically connecting the pair of electrical contacts during rotation of the first disk with respect to the second disk.

16. The clock device of claim 15 wherein the pair of electrical contacts are circumferentially spaced from each other, and the connector strip extending along an arc.

17. The clock device of claim 16 wherein radial axes pass through the electrical contacts define a contact separation angle, a contact bisecting axis bisecting the contact separation angle, the contact bisecting axis defining an offset angle with respect to the second slot of the second disk, the arc of the connector strip being bisected by a connector bisecting axis, the connector bisecting axis being offset from the first slot by an angle approximately equal to the offset angle of the pair of electrical contacts.

18. A day and night depicting clock device comprising:

a clock having a clock body, the clock body having a clock face wall, a clock movement mounted on the clock body and having a plurality of concentric drive shafts extending through the clock face wall including an hour drive shaft rotating once every twelve hours, a pair of time-displaying hands mounted on the drive shafts;

a first disk positioned in front of the clock face wall and mounted on the hour drive shaft for rotation with the hour drive shaft, the first disk including a first central hole through a center of the first disk, a first slot extending radially in the first disk from the first central hole to an outer edge of the first disk, the first disk being formed out of a resiliently flexible material to permit flexing of a portion of the first disk out of a plane of a remainder portion of the first disk, the first disk being a relatively light color to identify daytime;

a second disk positioned in front of the clock face wall and behind the first disk, the second disk being fixed against rotation with respect to the clock face wall, the second disk including a second central hole through a center of the second disk, a second slot extending radially from the second central hole to an outer edge of the second disk, the second disk being formed from a resiliently flexible material to permit flexing of a portion of the second disk out of a plane of a remainder portion of the second disk, the second disk being a relatively dark color to identify night-time, the first disk being movable through the second slot of the second disk;

shifting means for shifting a portion of one said disk with respect to another said disk, the shifting means selectively moving a portion of the disks toward the clock face wall to cause the first disk to move through the second slot of the second disk to shift the first disk either from a position behind the second disk to a position in front of the second disk or from a position in front of the second disk to a position in behind the second disk: and actuating means for periodically actuating the shifting means;

wherein the second disk has a diameter greater than a diameter of a second disk.

19. The clock device of claim 18 wherein the shifting means comprises a pair of shifting assemblies, each of the shifting assemblies being positioned lateral to a twelve o'clock position on the clock face wall, a left one of the shifting assemblies being positioned laterally left of the twelve o'clock position and a right one of the shifting assemblies being positioned laterally right of the twelve o'clock position.

20. The clock device of claim 19 wherein each of the shifting assemblies comprises:

a shifting arm for selectively contacting a location on the second disk for shifting the disks toward the clock face wall; and a shifting solenoid for moving the shifting arm toward the clock face wall and from a passive position to an active position, the active position being relatively closer to the clock face wall than the passive position.

* * * * *